US006012460A

United States Patent [19]

Kikuchi

[11] Patent Number: 6,012,460

[45] Date of Patent: Jan. 11, 2000

[54] WIG

[76] Inventor: Naomi Kikuchi, 206, Kamiyachi, Niigata-ken, Japan

[21] Appl. No.: 09/228,730

[22] Filed: Jan. 12, 1999

Related U.S. Application Data

[63] Continuation-in-part of application No. 09/131,718, Aug. 10, 1998, abandoned.

[30] Foreign Application Priority Data

Feb. 6, 1998 [JP] Japan ..... 10-153412
Sep. 30, 1998 [JP] Japan ..... 10-278950

[51] Int. Cl.[7] ..... A41G 3/00

[52] U.S. Cl. ..... 132/53; 132/54; 132/201

[58] Field of Search ..... 132/53, 54, 201

[56] References Cited

U.S. PATENT DOCUMENTS

| | | | |
|---|---|---|---|
| 3,385,305 | 5/1968 | Buzzelli | 132/53 |
| 3,651,820 | 3/1972 | Johnson et al. | 132/53 |
| 3,662,766 | 5/1972 | Maassen et al. | 132/53 |
| 3,694,819 | 10/1972 | Meyer | 132/53 |
| 3,848,612 | 11/1974 | Kohler | 132/53 |
| 3,980,092 | 9/1976 | Garufi . | |
| 4,155,370 | 5/1979 | Nemoto | 132/53 |
| 4,825,886 | 5/1989 | Allen | 132/54 |
| 5,592,957 | 1/1997 | Gazzerro et al. | 132/53 |
| 5,657,774 | 8/1997 | Niese | 132/54 |

FOREIGN PATENT DOCUMENTS

| | | | |
|---|---|---|---|
| 425241 | 5/1991 | European Pat. Off. . | |
| 425241 | 5/1991 | Japan | 132/53 |
| 1494787 | 12/1977 | United Kingdom | 132/53 |

*Primary Examiner*—Gene Mancene
*Assistant Examiner*—Pedro Philogene
*Attorney, Agent, or Firm*—Quarles & Brady

[57] ABSTRACT

A wig which is easy to attach and detach, with comfortableness in use. A wig 1 comprises a skin body, having a curved face for covering the head and the hair 3 provided on its surface, a first Hook and Loop fastener 4 provided on the skin body, and second plural Hook and Loop fasteners 5 for the head. Each second Hook and Loop fastener 5 is attached to the user's own hair, corresponding to the nearly intermediate portion of the width of the fastener 4, around his head. With the Hook and Loop fasteners 4 and 5, there can be provided a wig which is easy to attach and detach, with comfortablenss in use.

19 Claims, 8 Drawing Sheets

WIG

CROSS REFERENCE TO RELATED APPLICATIONS

This application is a continuation-in-part application of U.S. Ser. No. 09/131,718 filed on Aug. 10, 1998, now abandoned.

BACKGROUND OF INVENTION

1. Filed of the Invention

The present invention relates to a wig, particularly to the one which can be easily attached and detached, giving a comfortableness in use.

2. Prior Art

Conventionally, there have been proposed several means for attaching a wig or a headpiece. For example, the attachment by means of an adhesive tape, an adhesive, one-touch pins and etc. The means using an adhesive tape is the one in which an adhesive tape such as a double-sided tape is stuck to the reverse side of a wig for covering the head so as to fixedly attach the wig onto the head. The means using an adhesive is the one in which an adhesive is directly applied to the hair on the head so as to bond the reverse side of a wig thereto. The means using a one-touch pin is the one where a one-touch pin is provided at the reverse side of a wig so as to fix the wig to the hair, using the pin.

According to the above prior art, however, there have been several problems hereinbelow described. For example, for the means using an adhesive tape, the adhesion is so inferior that it is not suited for the repeated attachment and detachment of a wig.

On the other hand, for the means using an adhesive, if the hair grows where a wig is bonded, bonded portions on the head would be shifted and thus the position of the wig would be displaced or made wobbly. For this reason, the adhesive had to be replaced at the intervals of about 10 to 20 days. Such replacement of adhesive, however, is so difficult for an unskilled user that he had to ask a skilled professional to do so every time of the replacement.

Further, with such prior art, it was impossible for a user to attach or detach a wig whenever he liked, so that he had to wear a wig at all times, and thus there was a problem that he could not wash the hair even in a hot season. Furthermore, for the means using one-touch pin, it is indeed advantageous as it enables the easy attachment and detachment of a wig, but the user would feel pains due to the pin pressing his head when he lay in bed for sleep, and thus there was a problem that the wig had to be detached at the time of sleep. In other words, there have heretofore been no wigs or headpieces which a user can easily attach and detach by himself, with no pains on the head when he lies.

SUMMARY OF THE INVENTION

To eliminate the above mentioned problems, it is, therefore, an object of the present invention to provide a wig which is easy to attach and detach, with a comfortableness in use.

To attain the above objects, there is proposed a wig which comprises: a skin body for covering the head of a user, said skin body having an outer face and an inner face, with the hair provided on the outer face; one or more first Hook and Loop fasteners of a comparatively soft loop type, provided on the inner face of said skin body; second Hook and Loop fasteners of a comparatively hard hook type, provided for attaching to the head, each of said second fasteners being formed smaller than each of said first fasteners, and able to engage said first fasteners, wherein each of said first fasteners is 1 to 6 cm in width, provided on the skin body made of a ventilating material such as a net, along a peripheral side of the wig, while each of said second fasteners is 0.5 to 4 cm in width, provided along a peripheral side of the head, and wherein, each second fastener is provided on an inside face thereof with a base body having an adhesive layer thereon, while each first fastener is disposed on the skin body in the radial direction.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE INVENTION

Figure 1:
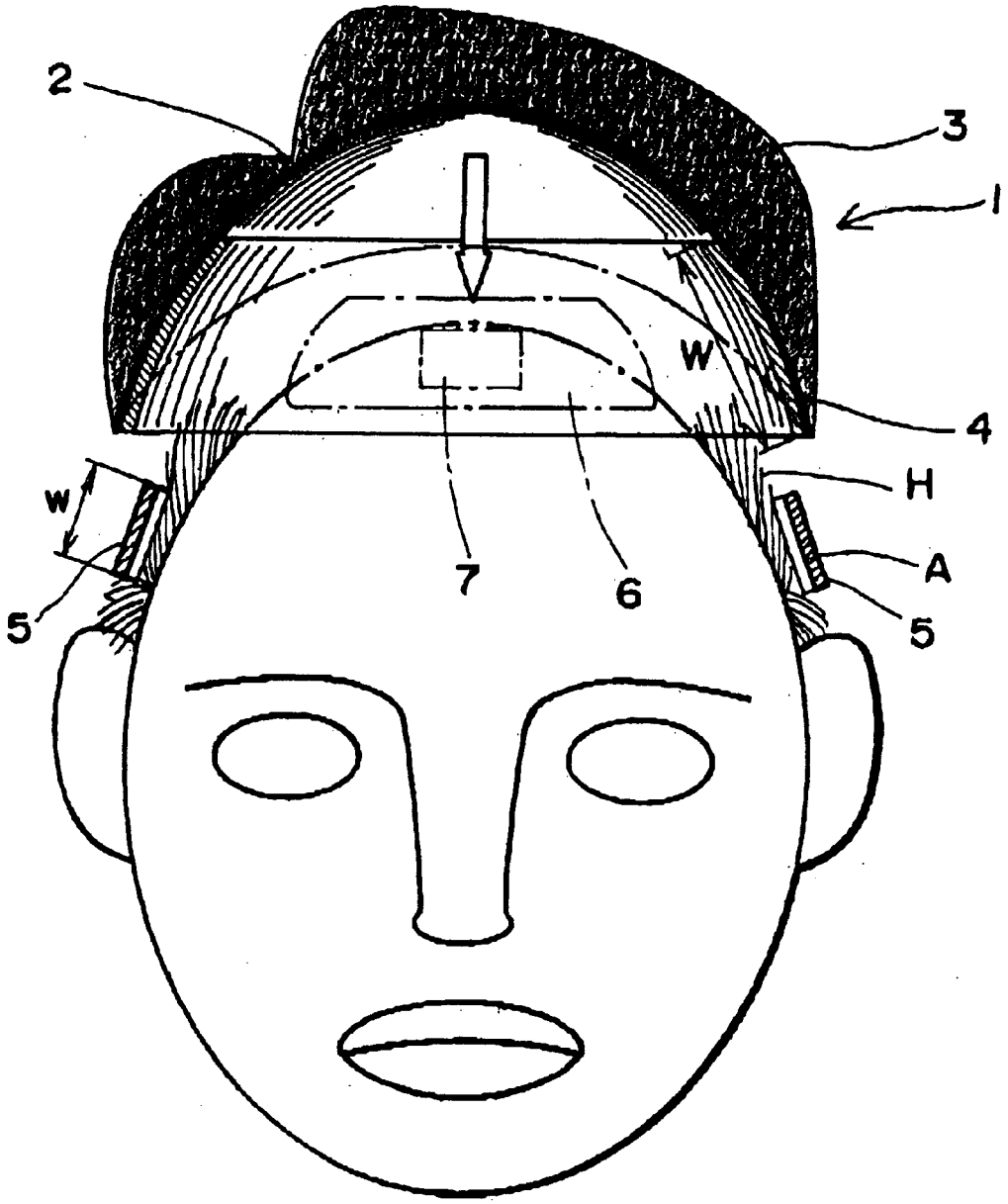
FIG. 1 is a section showing a wig of a first embodiment of the invention.

Hereinafter is explained a first embodiment of a wig of the invention with reference to FIG. 1 through FIG. 4.

Reference numeral 1 designates a wig, which comprises a skin body 2 formed from a sheet and/or a net made of soft resin or elastomer, said skin body 2 including hair 3 and a curved face for covering the head of a user, a loop-type Hook-and-Loop fastener 4 for a wig which is bonded to the reverse side of the wig 1 using reinforced bond (not shown) or the like, a hook-type Hook-and-Loop fastener 5 for attachment to the head, said hook-type fastener 5 being engageable with said loop-type fastener 4.

Figure 2:
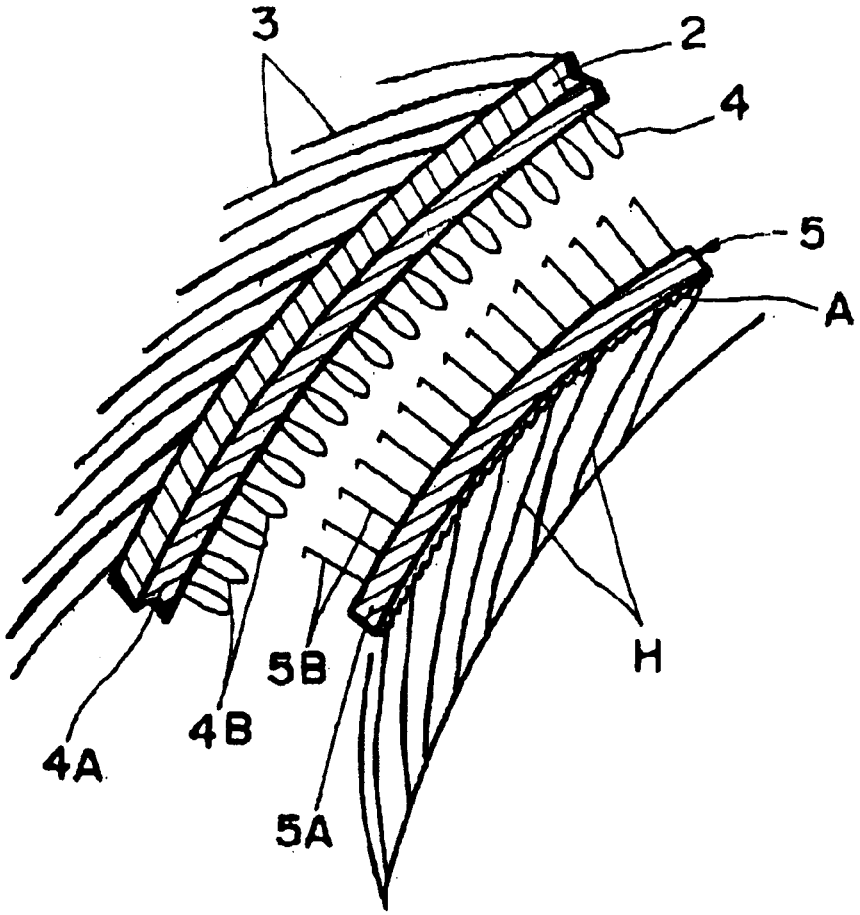
FIG. 2 is a section showing a principal part of a wig of a first embodiment of the invention.
Figure 3:
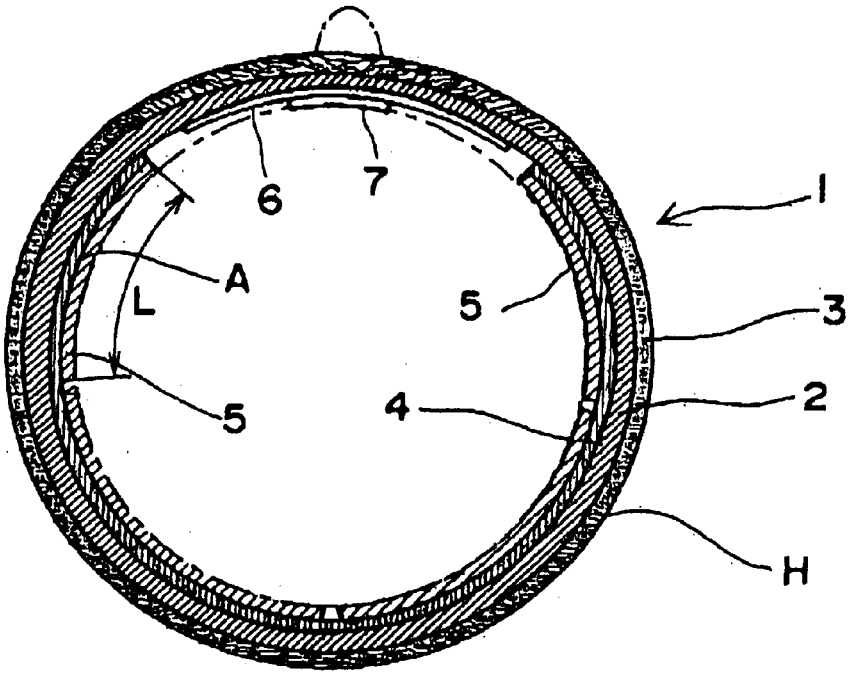
FIG. 3 is a transverse section showing a wig of a first embodiment of the invention.
Figure 4:
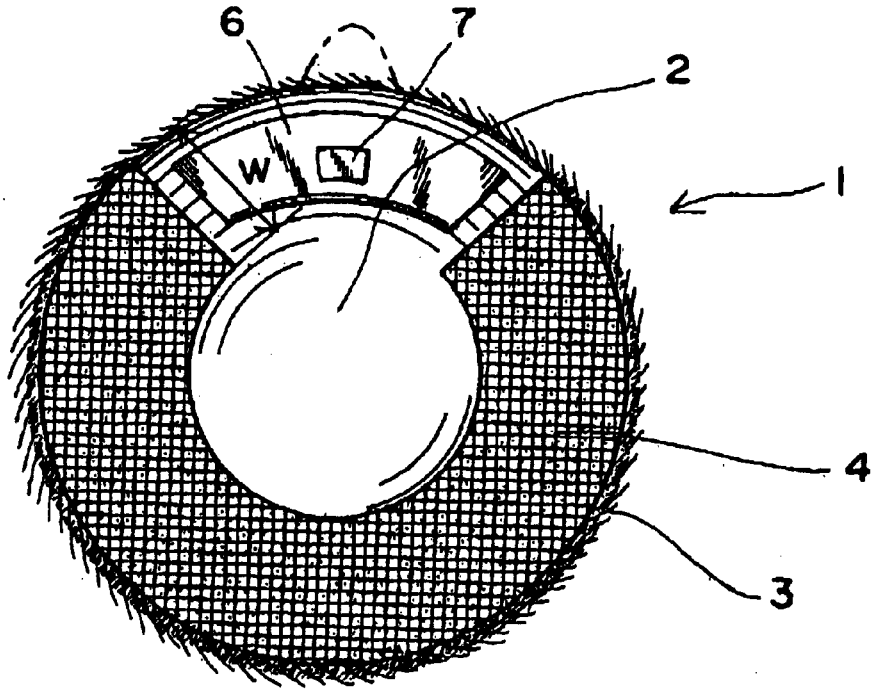
FIG. 4 is a bottom plan view showing a skin body of a wig of a first embodiment of the invention.

Said Hook-and-Loop fasteners 4 and 5 are sometimes called a velvet fastener as well. Said loop-type fastener 4 has some portion of its bottom surface cutaway to be shaped like letter C, corresponding to the forehead of a user, as shown in FIG. 4. The loop-type fastener 4 is band-shaped, having a width (W) of 1 to 6 cm, desirably 4 cm, from the top side to the downside, which is, as shown in FIG. 3, attached along the inside peripheral side edge of the wig 1. As illustrated in FIG. 2, said Hook-and-Loop fastener 4 includes a band-shaped base 4A fixed to the skin body 2, having an attachment portion 4B with soft loops extending toward the head. The hook-type fastener 5 for the head is also band-shaped, having a width (w) of from 0.5 to 4 cm, desirably about 1 to 2 cm from the top side to the downside, and thus it is narrower than said width (W) of the loop-type fastener 4, with a length (L) taken in the peripheral side direction being 1 to 15 cm, desirably about 5 to 10 cm. Thus, a plurality of the hook-type fasteners 5 are arranged in the direction of the side periphery.

As shown in FIG. 2, said Hook and Loop fastener 5 is provided with a band-shaped base 5A for fixedly attaching to the hair H of a user, and a hook-type comparatively hard attachment portion 6B which is provided on said base 5A, extending toward the wig 1 so as to detachably engage said attachment portion 4B. Incidentally, the softness of said attachment portion 4B is intended to mean herein that it is formed softer relative to the hook-type attachment portion 5B. Additionally, to the reverse face of a portion of said skin body 2 opposite to the forehead of a user or the cutaway portion of the loop-type fastener 4 is bonded a thin plate-like front portion 6 made for example of a transparent plastic film or the like, using an adhesive such as a reinforced bond, so that the front portion 6 can be removably fixed to the forehead, using a double-sided adhesive tape 7.

Next, the action is explained concerning the above-mentioned structure.

Initially, the hair H of a user is bristled up, while each of the Hook and Loop fasteners 5 for the head is installed around the head, corresponding to the nearly intermediate area of the width of said Hook and Loop fastener 4 for the wig. In that case, each Hook and Loop fastener 5 for the head may be directly stuck to the hair H by applying an adhesive A such as reinforced bond to the reverse, head-facing side of each Hook and Loop fastener 5 for the head.

Then, the skin body 2 is allowed to cover the head so as to engage the Hook and Loop fastener 4 for the wig with the Hook and Loop fasteners 5 for the head, so that the wig 1 is attached to the head.

When shampooing the hair, the wig 1 can be detached by grasping it and then peeling off the attachment portion of the Hook and Loop fastener 4 for the wig from the Hook and Loop fasteners 5 for the head. In the meantime, the wig 1 is able to be prevented from coming off from the forehead, by fixing the front portion 6 to the forehead, using the double-sided adhesive tape 7.

It should be noted that the attachment and detachment of the wig 1 thus structured can be very easily repeated by a user for himself. Further, since the wig 1 does not include any hard attachment members, the head of a user is never pressed even when he lies with the wig 1 attached to his head, and thus, he is free from any pains. Moreover, since the Hook and Loop fastener 4 for the wig is a soft loop-type in this embodiment, the touch is so soft when contacted by the head that it is made very comfortable in use. Specifically, although the positions of the Hook and Loop fasteners 5 for the head are shifted relative to the head as the user's hair H grows due to a long-term use of the wig 1,. according to the embodiment, however, the width (w) of each Hook and Loop fastener 5 for the head is smaller than the width (W) of the Hook and Loop fastener 4 for the wig, by for example 2 to 3 cm, and thus the position of the Hook and Loop fastener 4 for the wig yet agrees that of each Hook and Loop fastener 5 for the head even if the respective position of each Hook and Loop fastener 5 for the head is displaced relative to the head due to the growing of the hair H, whereby the wig 1 can be prevented from being shifted or made wobbly. When the hair H grows further, the user may strip off the adhesive A and have his hair cut if necessary, and thereafter, attach each Hook and Loop fastener 5 for the head to the hair H again, using the adhesive A.

It should be appreciated that the wider fastener 4 for the wig is also advantageous in that it enables easier engagement of the Hook and Loop fastener 4 with the Hook and Loop fasteners 5 when wearing the wig 1.

Next, second to seventh embodiments of the invention are explained with reference to FIGS. 5 through 9. The same portions as those described in the first embodiment will be designated as the same reference numerals, and their repeated descriptions will be omitted.

Figure 5A:
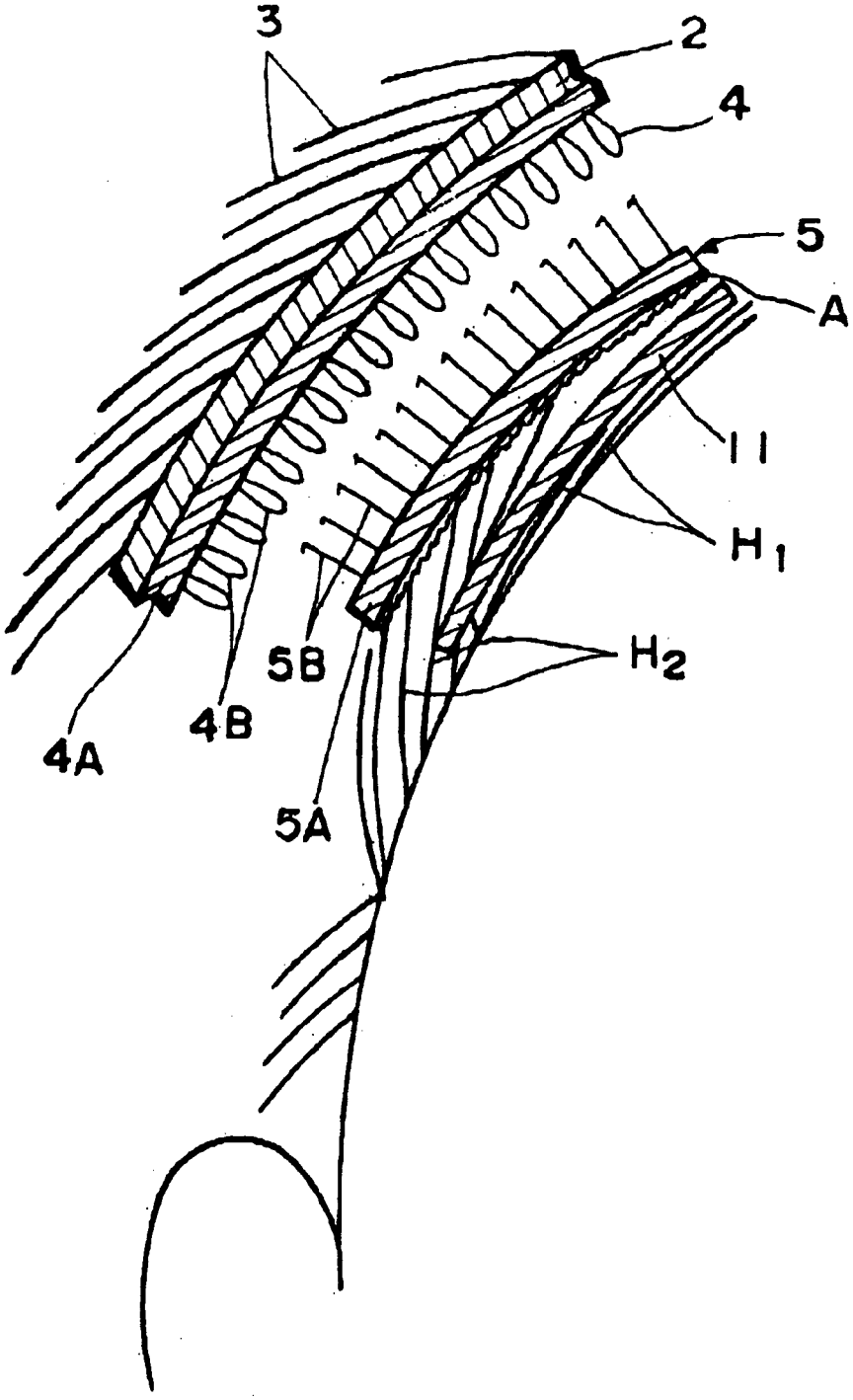
FIG. 5A is a section showing a wig of a second embodiment of the invention.
Figure 5B:
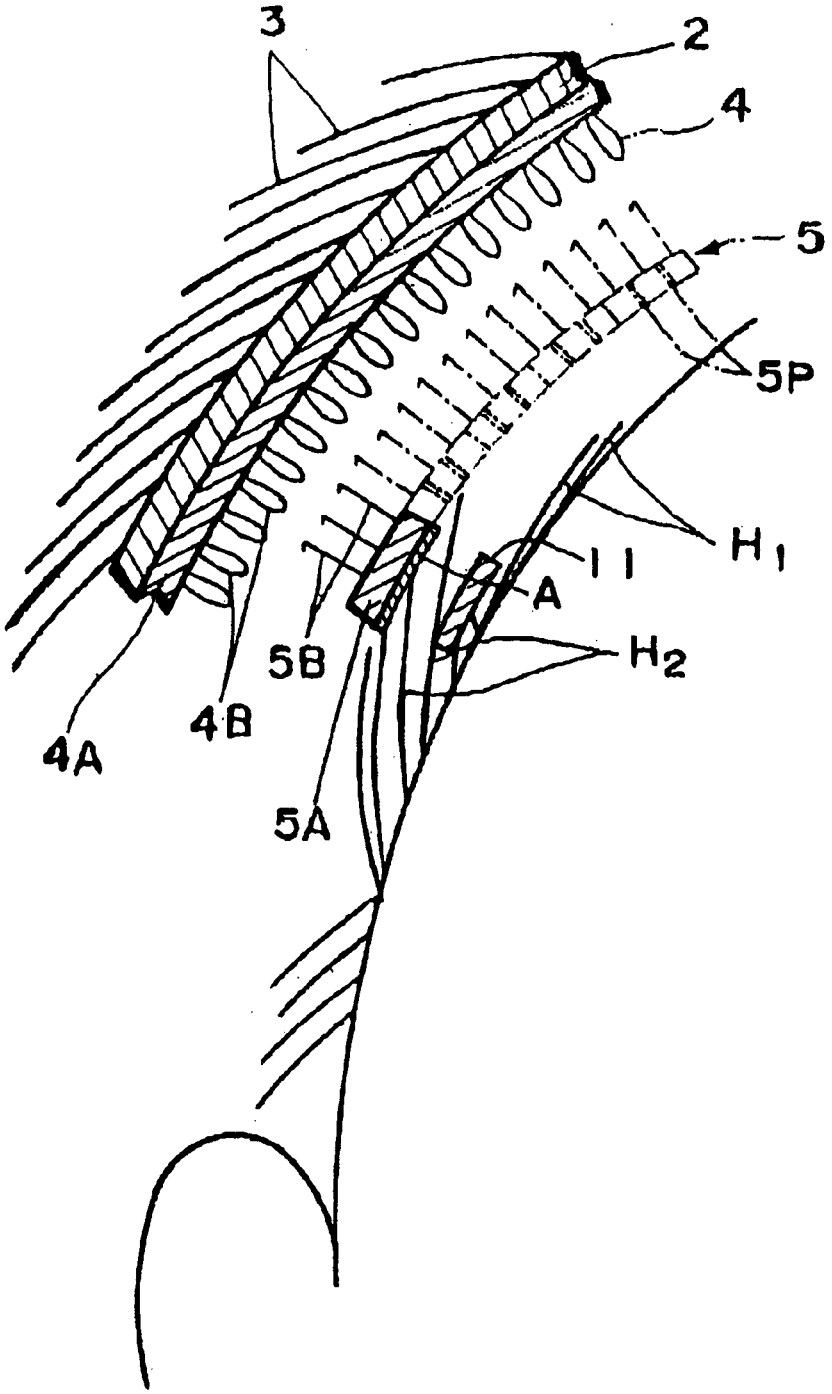
FIG. 5B is a section showing a wig of a third embodiment of the invention.

Unlike the first embodiment where the adhesive A of the Hook and Loop fasteners 5 was directly applied to the head, the adhesive A thereof is not directly contacted by the head in the second embodiment shown in FIGS. 5A and 5B. More specifically, the wig of the second embodiment shown in FIG. 5A further comprises an attachment base body 11 which is a plastic tape, a plastic film or a paper tape which has no adhesive layer at least on its inside face facing the head, said base body 11 being provided between the user's hair $H_1$ and the Hook and Loop fasteners 5. In other words, each Hook and Loop fastener 5 is provided on its inner face with the base body 11. Accordingly, each base body 11 is put onto to the user's hair $H_1$ bristled up beforehand. Then, each Hook and Loop fastener 5 is bonded to the base body 11 using the adhesive A, with the user's hair $H_2$ outside around the base body 11 being bristled up. Thereafter, the wig 1 can be attached to the head, in the same manner as the first embodiment, by allowing each Hook and Loop fastener 5 to engage with the Hook and Loop fastener 4.

In this case, a portion of the outside hair $H_2$ may be bonded to each Hook and Loop fastener 5 for the head, using the adhesive A. This is because the adhesion of the adhesive A is deteriorated with age in a few days, and thus the bonded hair is made easily come off therefrom.

When shampooing the hair, the wig 1 is grasped to peel off the attachment portion of the Hook and Loop fastener 4 for the wig from that of each Hook and Loop fastener 5, then peeling off the base body 11 from the head, thereby easily shampooing the hair.

Likewise, in a third embodiment shown in FIG. 5B also, there is provided an attachment base body 11 such as a plastic tape, a plastic film or a paper tape which has no adhesive layer at least on its inside face facing the head, said base body 11 being provided between the user's hair $H_1$ and the Hook and Loop fasteners 5. In this embodiment, the width of each fastener 5 and base body 11 is suppressed to about 1.0 cm, such that the width of each base body 11 and each fastener 5 may be at most half the width of the fastener 4, thus realizing less burden on the head. The adhesive A used in this embodiment is preferably a reinforced one, used for example for woodworking, which is used sufficiently to firmly bond the hair $H_2$ to between each base body 11 and fastener 5, such that the proximal end of the bonded base body 11 may be able to be more than 0.5 cm away from the user's head, thus preventing the skin of the user's head from being damaged by the adhesive A and the head from getting stuffy after wearing the wig 1. Alternatively, the width of the base body 11 does not have to be equal to that of the corresponding fastener 5, but may be widened like the second embodiment. In that case, a plurality of air holes 5P are desirably provided in the widened portion of each fastener 5.

Accordingly, each base body 11 is put onto to the user's hair $H_1$ bristled up beforehand. Then, each Hook and Loop fastener 5 is bonded to the base body 11 using the reinforced adhesive A, with the user's hair $H_2$ outside around the base body 11 being bristled up. Thereafter, the wig 1 can be attached to the head, in the same manner as the first embodiment, by allowing each Hook and Loop fastener 5 to engage with the Hook and Loop fastener 4.

In this case, although a portion of the outside hair $H_2$, each base body 11 and each fastener 5 are firmly bonded together by the reinforced adhesive A, it causes few troubles when shampooing the hair after removing the wig 1, because the width of each base body 11 and fastener 5 is small enough. Further, the wig 1 can be repeatedly worn after shampooing the hair. Furthermore, as the proximal end of each base body 11 after bonding is at least 0.5 cm away from the head, the skin of the user's head is less likely to be damaged or get a rash from the reinforced adhesive A, while preventing the head from getting too stuffy. Incidentally, additional base bodies 11 may be provided on where the user's hair further grows, thus enabling the optimal attachment of the wig 1 to the head, irrespective of a varying state of the user's hair.

As is apparent from the foregoing, according to the second and third embodiments, with the base body 11 provided between the head and the Hook and Loop fasteners 5, the adhesive A is made unlikely to adhere directly to the head, and thus the wig 1 can be attached to the head without feeling uncomfortable in use.

Figure 6:
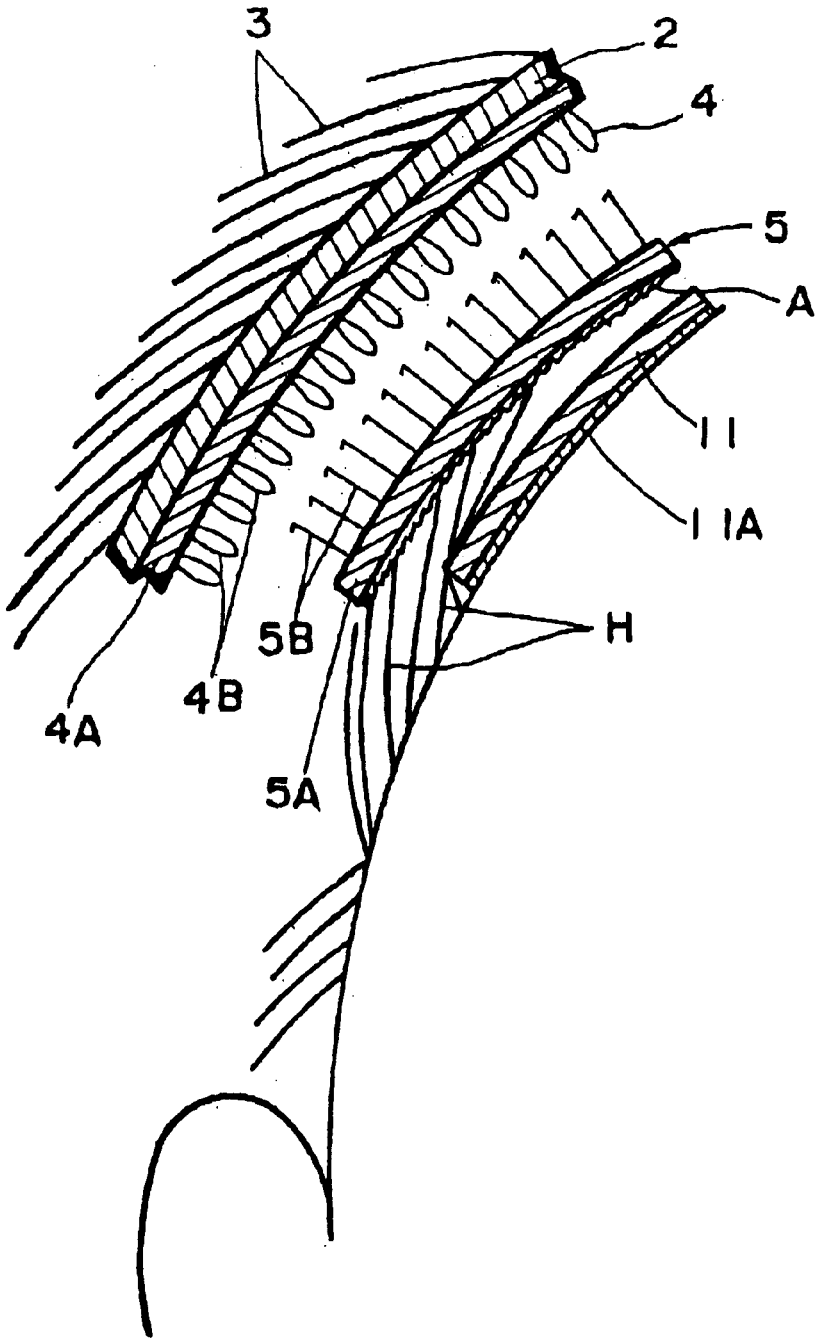
FIG. 6 is a section showing a wig of a fourth embodiment of the invention.

FIG. 6 shows a fourth embodiment of the invention, in which is also avoided the direct contact of the adhesive A with the head. In accordance with the fourth embodiment, the wig of the invention comprises the attachment base body 11 which is either a one-sided adhesive tape or a double-sided adhesive tape, having an adhesive layer at least on its inside face facing the head, said base body 11 being provided between the head and the Hook and Loop fasteners 5. In other words, each Hook and Loop fastener 5 is provided on its inner face with the base body 11 which has the adhesive layer 11A Accordingly, each base body 11 is stuck onto a bald area on the user's head. Then, each Hook and Loop fastener 5 is bonded to the base body 11 using the adhesive A, with the users hair H outside around the base body 11 being bristled up.

In this case, if the base body 11 has the adhesive layers (not shown) at its both sides, such as a double-sided adhesive tape, the adhesive A is not necessary. Thereafter, the wig 1 can be attached to the head, in the same manner as the first embodiment, by allowing each Hook and Loop fastener 5 to engage with the Hook and Loop fastener 4. In this case, a portion of the hair H may be bonded to each Hook and Loop fastener 5 for the head, with the adhesive A. This is because the adhesion of the adhesive A used in this embodiment is deteriorated with age in a few days, and thus the bonded hair will be made easily come off therefrom.

When shampooing the hair, the wig 1 is grasped to peel off the attachment portion of the Hook and Loop fastener 4 for the wig from that of each Hook and Loop fastener 5, then peeling off the base body 11 from the head, thereby easily shampooing the hair.

Figure 7:
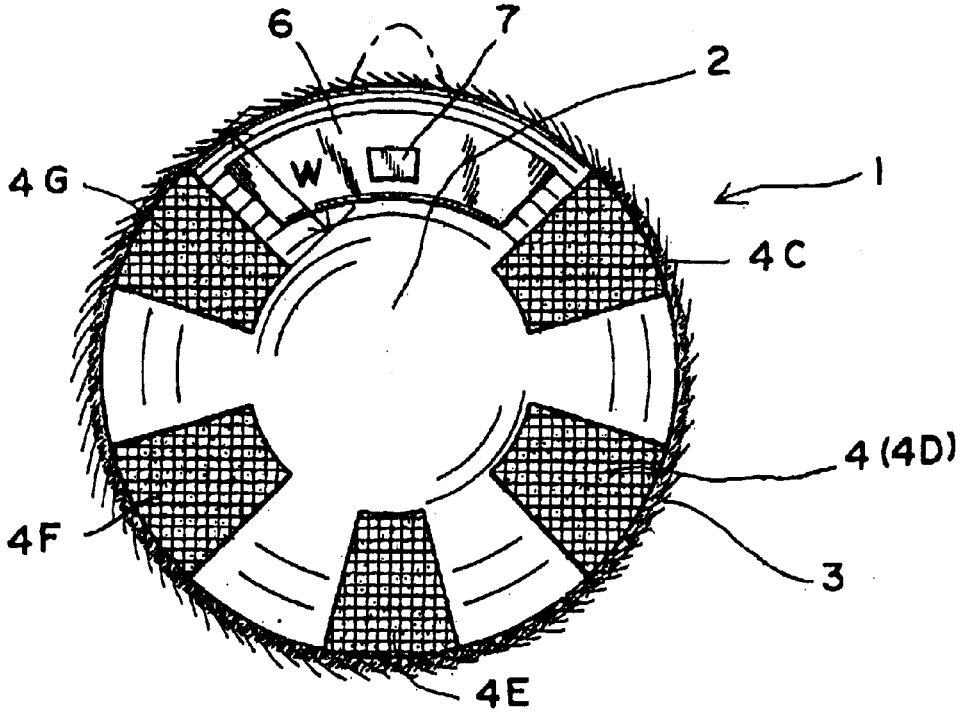
FIG. 7 is a bottom plan view showing a skin body of a fifth embodiment of the invention.

In FIG. 7 showing a fifth embodiment of the invention, the wig of the invention comprises a ventilating skin body 2 made for example of a net, and loop-type Hook and Loop fasteners 4C, 4D, 4E, 4F and 4G which are spacedly stuck, using a bonding means, to the reverse face of the skin body 2 in the radial direction. The width of each loop-type Hook and Loop fastener and the interval between the adjacent fasteners are each preferably 1 mm or above. The hook-type Hook and Loop fasteners 5 also are attached to the head, corresponding to the loop-type fasteners 4C,4D, 4E, 4F and 4G. Accordingly, the wig 1 of the invention can be attached to the head, by allowing the fasteners 4C,4D,4E,4F and 4G to engage with the fasteners 5.

The fifth embodiment is advantageous in that as the ventilating skin body 2 is exposed in each interval between the spacedly and radially disposed adjacent fasteners 4C and 4D, 4D and 4E, 4E and 4F, and 4F and 4G, the wig 1 is able to display a good ventilation property during the use, without getting stuffy, so that it can be worn comfortably over a long period of time.

Figure 8:
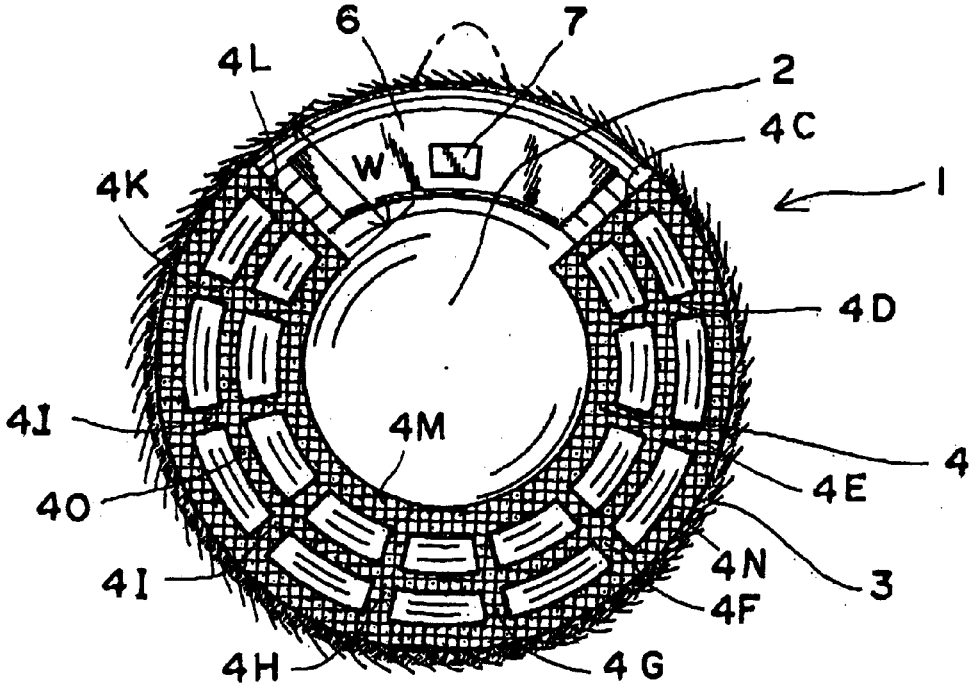
FIG. 8 is a bottom plan view showing a skin body of a sixth embodiment of the invention.

In FIG. 8 showing a sixth embodiment, the wig of the invention comprises a ventilating skin body 2 made for example of a net, loop-type Hook and Loop fasteners 4C,4D,4E,4F,4G,4H,4I,4J,4K and 4L which are spacedly stuck, using a bonding means, to the reverse face of the skin body 2 in the radial direction, an inner circumferential portion 4M provided along their inner peripheral edges for linking the said fasteners 4C through 4L one another, an outer circumferential portion 4N provided along their outer peripheral edges for linking them one another, and an intermediate circumferential portion 40 provided between said inner circumferential portion 4M and said outer circumferential portion 4N. Each loop-type Hook and Loop fastener, each interval between the adjacent fasteners, and the inner and outer circumferential portions 4M and 4N are each preferably 1 mm or above in width. The hook-type Hook and Loop fasteners 5 also are attached to the head, corresponding to the loop-type fasteners 4C through 4L. Accordingly, the wig 1 of the invention can be attached to the head, by allowing the fasteners 4C through 4L to engage with the fasteners 5.

The sixth embodiment is advantageous in that as the ventilating skin body 2 is exposed in each interval among the spacedly and radially disposed adjacent fasteners 4C through 4L, the wig 1 is able to display a better ventilation property during the use, without getting stuffy, so that it can be worn comfortably over a long period of time. In addition, the inner and outer circumferential portions 4M and 4N are able to prevent the edges of the wig 1 from coming oft and the intermediate circumstantial portion 40 also is able to prevent the coming off of the intermediate portion of the wig 1.

Referring to

Figure 9:
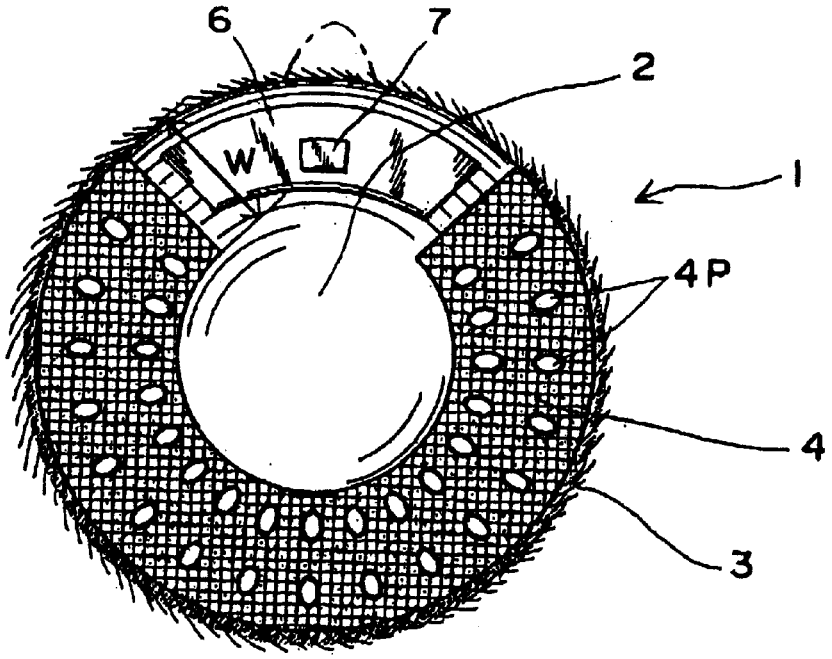
FIG. 9 is a bottom plan view showing a skin body of a seventh embodiment of the invention.

FIG. 9 showing a seventh embodiment of the invention, a plurality of air holes 4P are regularly scattered almost all over the loop-type Hook-and-Loop fastener 4 which is stuck, using a bonding means, to the reverse face of the ventilating skin body 2 made for example of a net. Accordingly, the wig 1 of the invention can be attached to the head, by allowing the fastener 4 to engage with the fasteners 5.

The seventh embodiment is advantageous in that as the ventilating skin body 2 is exposed in each air hole 4P of the fastener 4, the wig 1 is able to display a good ventilation property during the use, without getting stuffy, so that it can be worn comfortably over a long period of time.

The present invention should not be limited to the foregoing embodiments, but may be modified within a technical scope of the invention. For example, although both the Hook and Loop fastener 4 for the wig and the Hook and Loop fastener 5 for the head are band-shaped in the foregoing embodiments, they may be shaped into other various forms, which, for example, may be shaped to the forms of rectangular-shaped or circular-shaped fasteners. Further, it should be noted that the attaching position of each fastener should vary, depending on a present state of the hair of a user. Furthermore, although the front portion 6 of the wig 1 is detachably fixed to the forehead of a user with the use of the double-sided tape 7 in the forgoing embodiments, a Hook and Loop fastener for the forehead may be attached to the forehead using a double-sided tape, while another Hook and Loop fastener for the wig may be provided on said front portion G for engaging with the former fastener, such that both may be allowed to engage each other to prevent the wig from coming off from the forehead. Alternatively, the Hook and Loop fastener 4 for the wig may be a hook-type, while each Hook and Loop fastener 5 for the head may be a loop-type. It should be noted that the wig of the present invention should include a hairpiece, a toupee and the like.

What is claimed:

1. A wig which comprises:

a skin body for covering the head of a user, said skin body having an outer face and an inner face, made of a ventilating material, and with hair provided on the outer face;

first Hook and Loop fasteners provided on a rear face of said skin body;

second Hook and Loop fasteners provided for attaching to the head, each of said second fasteners being provided along a peripheral side of the head, formed smaller than each of said first fasteners, and able to engage said first fasteners, wherein each second fastener is provided on an inside face thereof with a base body having an adhesive layer thereon, while each first fastener is disposed on the skin body in the radial direction, wherein each first fastener is spacedly disposed, while each second fastener also is spacedly disposed, corresponding to each first fastener, and wherein each first fastener is provided on the rear face of said skin body except an area opposite to the forehead of a user, while a double-sided adhesive tape is provided on the area.

2. A wig according to claim 1, wherein said adhesive layer of the base body is provided on an inside face of the base body.

3. A wig according to claim 1, wherein said first fasteners are provided spacedly in the radial direction.

4. A wig according to claim 1, wherein each of said first fasteners is 1 to 6 cm in width, while each of said second fasteners is 0.5 to 4 cm in width.

5. A wig which according to claim 1, wherein each of said first fasteners is of a comparatively soft loop type, while each of said second fasteners is of a comparatively hard hook type.

6. A wig which comprises:

a skin body for covering the head of a user, said skin body having an outer face and an inner face, made of a ventilating material, and with hair provided on the outer face;

a first Hook and Loop fastener provided on the inner face of said skin body;

one or more second Hook and Loop fasteners provided for attaching to the head, each of said second fasteners being formed smaller than said first fastener, and able to engage said first fastener, wherein said first fastener is provided with a plurality of radial air holes nearly all over an entire face thereof, provided along a peripheral side of the wig, while each of said second fasteners is provided along a peripheral side of the head, and wherein each second fastener is provided on an inside face thereof with a base body having an adhesive layer thereon.

7. A wig according to claim 6, wherein said adhesive layer of the base body is provided on an inside face of the base body.

8. A wig according to claim 6, wherein said first fastener is 1 to 6 cm in width, while each of said second fasteners is 0.6 to 4 cm in width.

9. A wig which according to claim 6, wherein each of said first fasteners is of a comparatively soft loop type, while each of said second fasteners is of a comparatively hard hook type.

10. A wig which comprises:

a skin body for covering the head of a user, said skin body having an outer face and an inner face, made of a ventilating material, and with hair provided on the outer face;

one or more first Hook and Loop fasteners provided on the inner face of said skin body in the radial direction;

second Hook and Loop fasteners provided for attaching to the head, each of said second fasteners being provided along a peripheral side of the head, formed smaller than each of said first fasteners, and able to engage said first fasteners, and base bodies for mounting said second fasteners to the head;

wherein there is provided an adhesive to be filled in between each second fastener and base body in a manner that a portion of the user's hair is fixedly sandwiched therebetween, wherein each first fastener is spacedly disposed,'while each second fastener also is spacedly disposed, corresponding to each first fastener, and wherein each first fastener is provided on the rear face of said skin body except an area opposite to the forehead of a user, while a double-sided adhesive tape is provided on the area.

11. A wig according to claim 10, wherein each base body is formed to 1 to 1.5 cm width.

12. A wig according to claim 10, wherein each base body is bonded to each second fastener in a manner that a proximal end of the base body may be able to be at least 0.5 cm away from the head.

13. A wig which according to claim 11, wherein each first fastener is spaced relative to a peripheral side direction of the skin body, formed narrower in an upper portion than in a lower portion, while each second fastener is provided, corresponding to each first fastener, having plural air holes formed thereon.

14. A wig which according to claim 12, wherein each first fastener is spaced relative to a peripheral side direction of the skin body, formed narrower in an upper portion than in a lower portion, while each second fastener in provided, corresponding to each first fastener, having plural air holes formed therein.

15. A wig which according to claim 11, wherein each first fastener is spaced relative to a peripheral side direction of the skin body, arranged in a plural ranks, while each second fastener is provided, corresponding to each first fastener, having plural air holes formed therein.

16. A wig which according to claim 12, wherein each first fastener is spaced relative to a peripheral side direction of the skin body, arranged in plural ranks, while each second fastener is provided, corresponding to each first fastener, having plural air holes formed therein.

17. A wig which according to claim 11, wherein said first fastener is provided with a plurality of radial air holes nearly all over an entire face thereof, while each second fastener is provided, corresponding to the first fastener, having plural air holes formed therein.

18. A wig which according to claim 12, wherein said first fastener is provided with a plurality of radial air holes nearly all over an entire face thereof, while each second fastener is provided, corresponding to the first fastener, having plural air holes formed therein.

19. A wig which according to claim 10, wherein each of said first fasteners is of a comparatively soft loop type, while each of said second fasteners is of a comparatively hard hook type.

* * * * *

UNITED STATES PATENT AND TRADEMARK OFFICE

CERTIFICATE OF CORRECTION

PATENT NO. : 6,012,460
DATED : January 11, 2000
INVENTOR(S) : Kikuchi

It is certified that error appears in the above-identified patent and that said Letters Patent is hereby corrected as shown below:

Column 3:
Line 12, replace "6B" with --5B--.

Column 6:
Line 22, replace "40" with --40--.

Column 6:
Line 40, replace "oft" with --off--.

Column 6:
Line 41, replace "40" with --40--.

Column 7:
Line 8, replace "G" with --6--.

Column 8 Claim 10:
Line 33, before "while" delete " ' ".

Signed and Sealed this

Twelfth Day of June, 2001

Nicholas P. Godici

*Attest:*

*Attesting Officer*

NICHOLAS P. GODICI
*Acting Director of the United States Patent and Trademark Office*